US008696095B2

(12) United States Patent
Urabe

(10) Patent No.: US 8,696,095 B2
(45) Date of Patent: Apr. 15, 2014

(54) FLUID SUPPLY DEVICE, PRINTING DEVICE, AND METHOD OF CONTROLLING A FLUID SUPPLY DEVICE

(75) Inventor: Yuichi Urabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 573 days.

(21) Appl. No.: 12/558,410

(22) Filed: Sep. 11, 2009

(65) Prior Publication Data

US 2010/0066774 A1 Mar. 18, 2010

(30) Foreign Application Priority Data

Sep. 12, 2008 (JP) ..... 2008-234410

(51) Int. Cl.
*B41J 2/175* (2006.01)

(52) U.S. Cl.
USPC ..... 347/85; 347/7; 347/84; 347/86

(58) Field of Classification Search
None
See application file for complete search history.

(56) References Cited

U.S. PATENT DOCUMENTS 6,070,958 A 6/2000 Kanome
6,099,101 A * 8/2000 Maurelli et al. ..... 347/7
6,145,971 A * 11/2000 Baker et al. ..... 347/85
6,264,318 B1 * 7/2001 Oda et al. ..... 347/86
6,913,336 B2 7/2005 Hara
7,878,632 B2 2/2011 Kachi
2009/0322809 A1 * 12/2009 Yamada et al. ..... 347/7

FOREIGN PATENT DOCUMENTS

JP 11-010900 A 1/1999
JP 2002-307719 A 10/2002
JP 2004-122424 A 4/2004
JP 2004-160777 A 6/2004
JP 2006-056013 A 3/2006
JP 2007-044929 A 2/2007
JP 2008-087286 A 4/2008
JP 2001-071530 A 3/2011

* cited by examiner

*Primary Examiner* — Uyen Chau N Le
*Assistant Examiner* — Chad Smith
(74) *Attorney, Agent, or Firm* — Kilpatrick Townsend & Stockton LLP

(57) ABSTRACT

A fluid supply device, a printing device, and a control method for a fluid supply device can appropriately determine when the main tank should be replaced without increasing device cost or size. In a structure in which an expansion mechanism draws ink from an ink cartridge by expanding an ink cartridge using the force of carriage movement, a calculation means 112 calculates the remaining ink volume in the ink cartridge based on the ink discharge volume from the inkjet head, and a CPU 115 determines the ink cartridge replacement time has arrived when ink consumption in a specified number of ink packs has reached a specified remaining ink volume in a near-end range based on the result calculated by the calculation means 112.

16 Claims, 8 Drawing Sheets

FLUID SUPPLY DEVICE, PRINTING DEVICE, AND METHOD OF CONTROLLING A FLUID SUPPLY DEVICE

This application claims priority to Japanese Patent Application No. 2008-234410, filed Sep. 12, 2009, the entirety of which is incorporated by reference herein.

BACKGROUND OF THE INVENTION

1. Technical Field

The present invention relates to a fluid supply device that supplies fluid from a main tank through a sub tank to a head, to a printing device, and to a method of controlling fluid supply devices.

2. Description of Related Art

One example of a fluid supply device is a device that is incorporated in a printer connected to a personal computer, for example, and supplies fluid ink to the print head.

Japanese Unexamined Patent Appl. Pub. JP-A-2001-71530, for example, teaches a fluid supply device that has a printing control means for controlling a printing means, a maintenance operation control means, and an ink consumption control means, calculates ink consumption from the cleaning operations and ink droplet discharge count, and warns the user when the ink must be replaced.

The technology taught in JP-A-2001-71530 determines the ink consumption from the ink droplet discharge count and estimates the remaining ink volume, but the detection accuracy of this technology is not high. As a result, the threshold value for determining the ink end is set higher than the actual ink end level to provide a safety margin, the ink cartridge must therefore be replaced while some amount of ink is left, and ink is thus wasted.

SUMMARY OF THE INVENTION

A fluid supply device, a printing device, and a control method for a fluid supply device according to the present invention enable can appropriately determine when the main tank should be replaced without increasing device cost or size.

A first aspect of the invention is a fluid supply device including a main tank that stores fluid in a plurality of storage units; a sub tank having a fluid chamber to which fluid is supplied from the main tank; a head that discharges fluid supplied from the sub tank; a movable carriage on which the head and the sub tank are mounted; an expansion mechanism that expands the fluid chamber and draws fluid from the main tank by movement of a moving member that is moved through an elastic member as a result of carriage movement; a calculating means that calculates a remaining fluid volume in the storage units of the main tank from a fluid discharge volume from the head; and a decision means that determines the main tank replacement time has arrived when the remaining fluid volume in a specified number of storage units is a specified remaining fluid volume based on the calculated result from the calculating means.

The fluid supply device according to this aspect of the invention can avoid a specified number of storage units becoming empty at the same time because it is determined to be time to replace the main tank when the remaining fluid volume in a specified number of storage units is a specified remaining volume.

More specifically, because it is determined to be time to replace the main tank before a specified number of storage units become empty and the load on the carriage becomes great when drawing fluid with the expansion mechanism, the maximum load on the carriage can be reduced and the size of the drive assembly components, particularly including the motor, that cause the carriage to move can be reduced.

As a result, the main tank can be replaced at an appropriate time without increasing cost or size.

In a fluid supply device according to another aspect of the invention the decision means determines the main tank replacement time has arrived when at least one storage unit of the main tank is determined to be empty based on the load required to move the carriage.

The fluid supply device according to this aspect of the invention can suppress fluid waste and can replace the main tank at the appropriate time because it is determined to be time to replace the main tank when at least one storage unit in the main tank is determined to be empty based on the load required to move the carriage.

In a fluid supply device according to another aspect of the invention the storage units can be individually replaced.

Because the storage units can be replaced individually, the fluid supply device according to this aspect of the invention enables replacing only the storage units that are empty of fluid without replacing storage units in which fluid remains, and can thus minimize fluid waste.

Another aspect of the invention is a control method for a fluid supply device that has a main tank that stores fluid in a plurality of sealed, variable capacity storage units, a sub tank having a variable capacity fluid chamber to which fluid is supplied from the main tank, a head that discharges fluid supplied from the sub tank, a movable carriage on which the head and the sub tank are mounted, and an expansion mechanism that expands the fluid chamber and draws fluid from the main tank by movement of a moving member that is moved through an elastic member as a result of carriage movement, the control method including a remaining fluid volume calculating step that calculates a remaining fluid volume in the storage units of the main tank from a fluid discharge volume from the head; and a replacement time determination step that determines the main tank replacement time has arrived when the remaining fluid volume in a specified number of storage units is a specified remaining fluid volume based on the calculated result from the remaining fluid volume calculating step.

The control method for a fluid supply device according to this aspect of the invention can avoid a specified number of storage units becoming empty at the same time because it is determined to be time to replace the main tank when the remaining fluid volume in a specified number of storage units is a specified remaining volume.

More specifically, because it is determined to be time to replace the main tank before a specified number of storage units become empty and the load on the carriage becomes great when drawing fluid with the expansion mechanism, the maximum load on the carriage can be reduced and the size of the drive assembly components, particularly including the motor, that cause the carriage to move can be reduced.

As a result, the main tank can be replaced at an appropriate time without increasing cost or size.

The control method for a fluid supply device according to another aspect of the invention also has an empty determination step that determines at least one storage unit of the main tank is empty based on the load required to move the carriage, and the replacement time determination step determines the main tank replacement time has arrived when the empty determination step determines at least one storage unit of the main tank is empty.

The control method for a fluid supply device according to this aspect of the invention can suppress fluid waste and can replace the main tank at the appropriate time because it is determined to be time to replace the main tank when at least one storage unit in the main tank is determined to be empty based on the load required to move the carriage.

Another aspect of the invention is a printing device including an ink cartridge having a plurality of storage units that store ink for each color; a sub tank to which ink stored in the storage unit is supplied by a pump means; an inkjet head that discharges the ink supplied to the sub tank; a carriage on which the inkjet head is mounted and which moves bidirectionally widthwise to the paper; a drive means that drives the carriage bidirectionally; and a decision means that determines the ink cartridge replacement time. The pumping means has an expansion means that expands an ink chamber formed in the sub tank. The expansion means has a cylindrical cylinder, a movable member that moves inside the cylinder, and a rocking arm member that rocks in conjunction with a decrease in the ink volume in the ink chamber, and operates the movable member, expands the ink chamber, and fills the ink chamber with ink when the carriage moves bidirectionally. The decision means determines whether or not a remaining ink volume in the ink cartridge is a specified remaining volume in a near-end range based on the calculated ink discharge volume from the inkjet head, determines if the number of storage units in the near-end range is greater than or equal to a specified number if the remaining ink volume is determined to be the specified remaining volume, determines if the ink cartridge and the ink chamber are empty of ink and the carriage movement load is high in the real-end range if the number of storage units in the near-end range is less than the specified number, and determines that the ink cartridge replacement time has arrived and prompting ink cartridge replacement if the real-end range has been reached.

The printing device according to this aspect of the invention determines the ink end state using both the ink discharge volume from the inkjet head and the carriage movement load, and can therefore accurately determine the ink end.

Other objects and attainments together with a fuller understanding of the invention will become apparent and appreciated by referring to the following description and claims taken in conjunction with the accompanying drawings.

DESCRIPTION OF PREFERRED EMBODIMENTS

Preferred embodiments of a fluid supply device, a printing device, and a control method for a fluid supply device according to the present invention are described below with reference to the accompanying figures.

Figure 1:
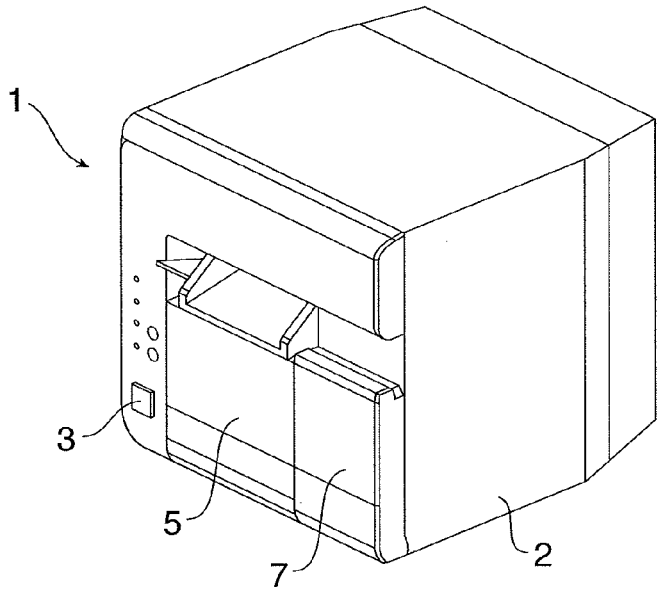
FIG. 1 is an oblique view of an inkjet printer as an example of a printing device according to a first embodiment of the present invention.
Figure 2:
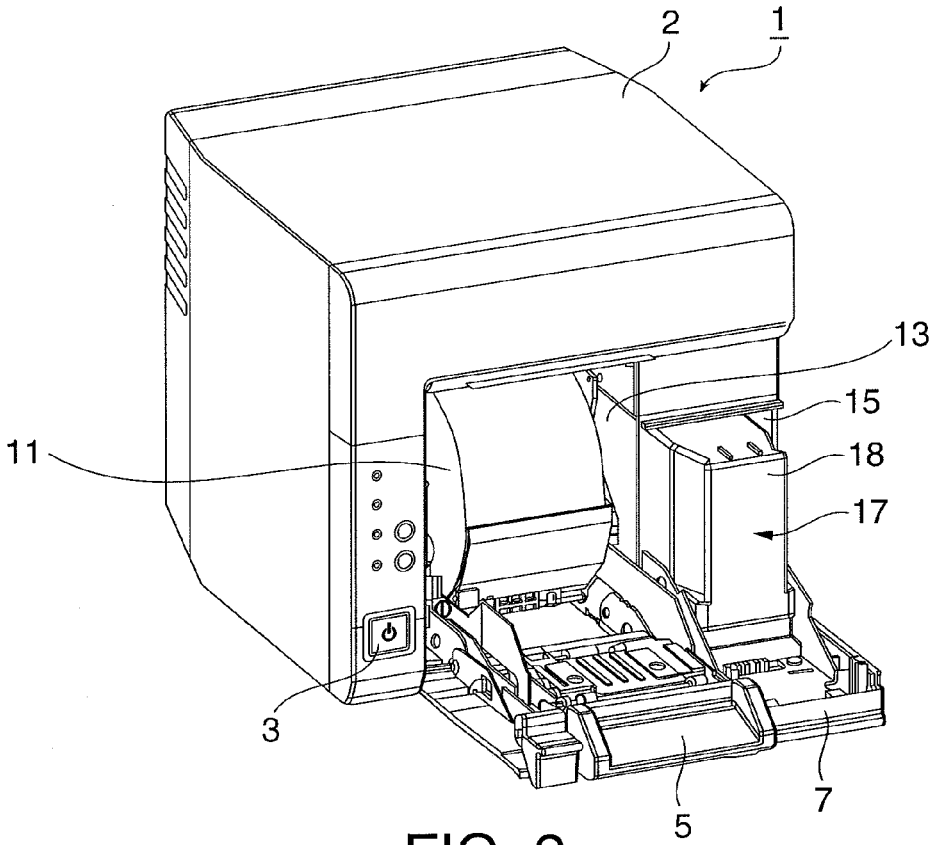
FIG. 2 is an oblique view of the inkjet printer with the printer cover open.
Figure 3:
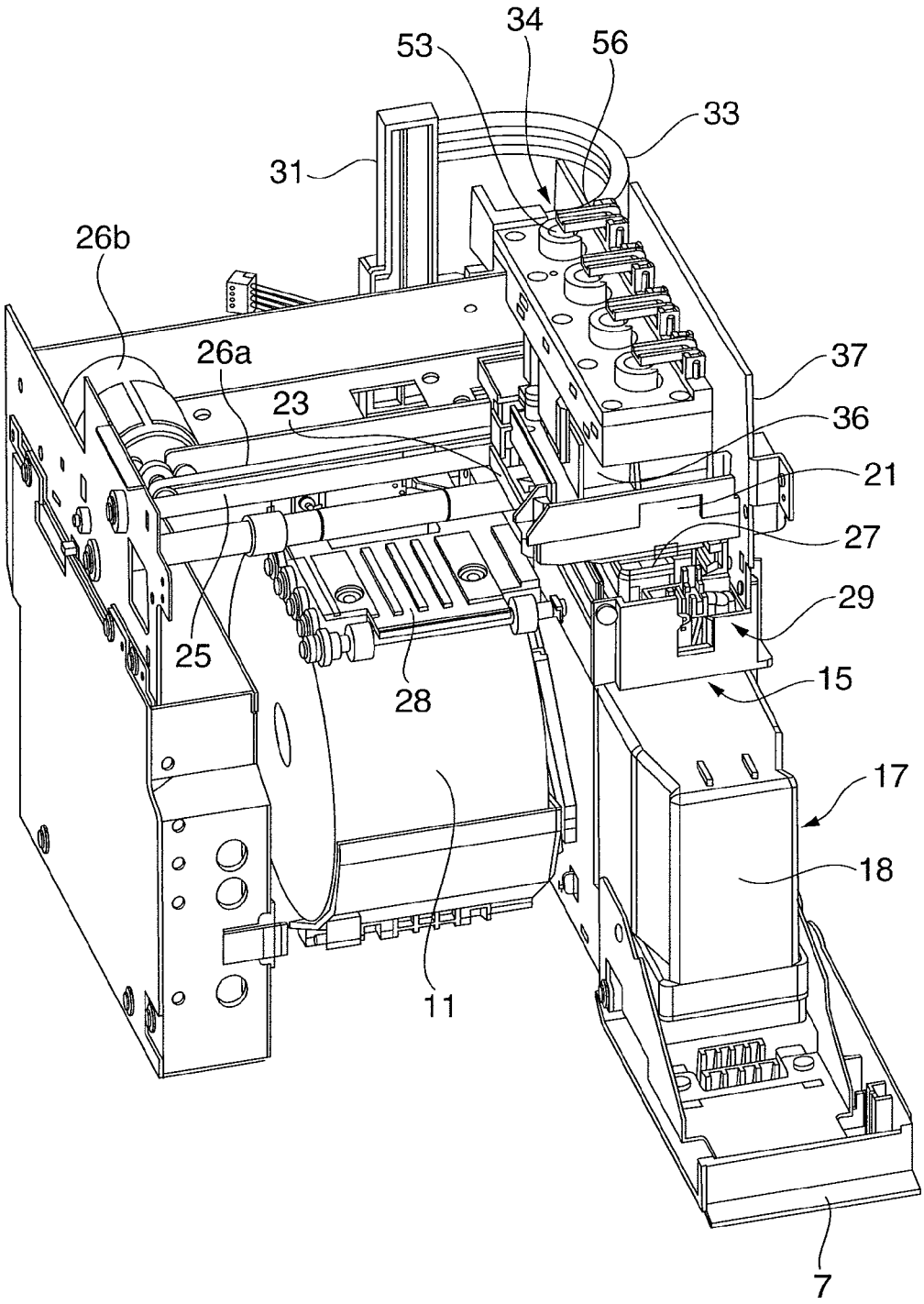
FIG. 3 is an oblique view of the inkjet printer with the printer case removed.
Figure 4:
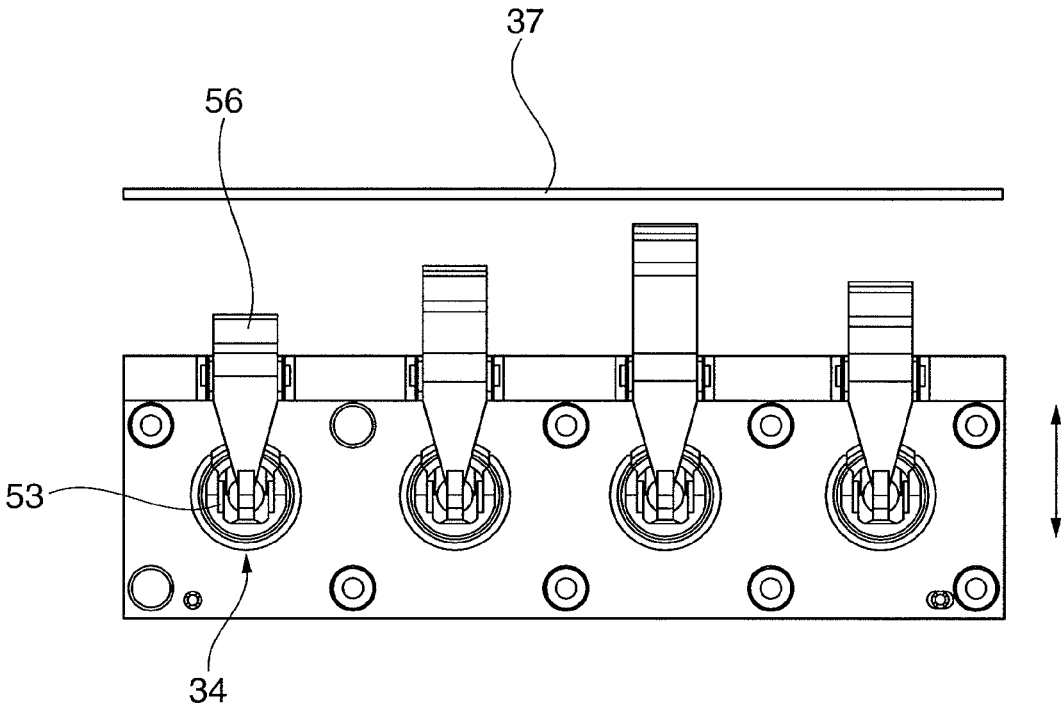
FIG. 4 is a plan view showing the ink pump unit and regulator plate of the inkjet printer.
Figure 5:
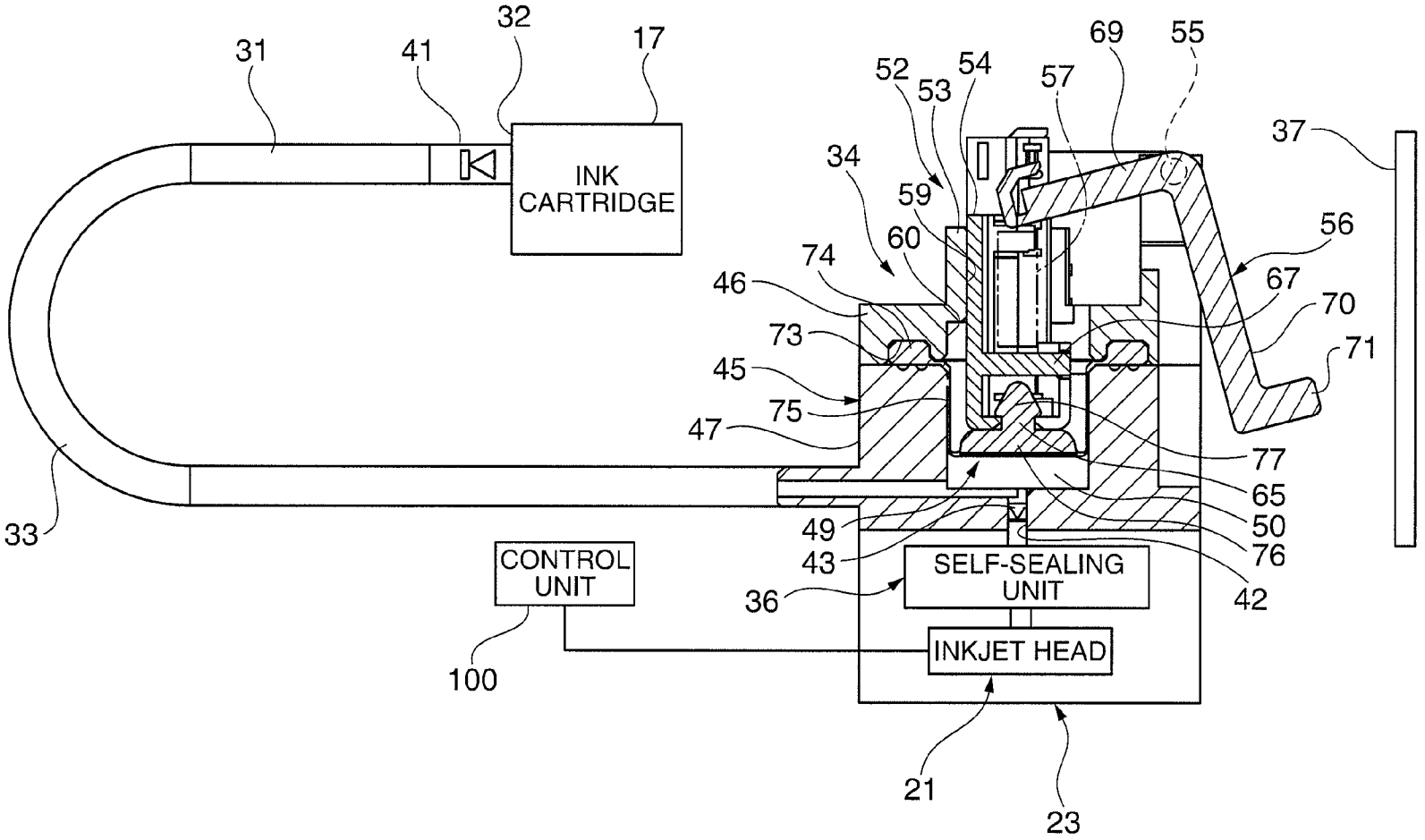
FIG. 5 is a section view showing the main parts of the ink supply mechanism of the inkjet printer.
Figure 6:
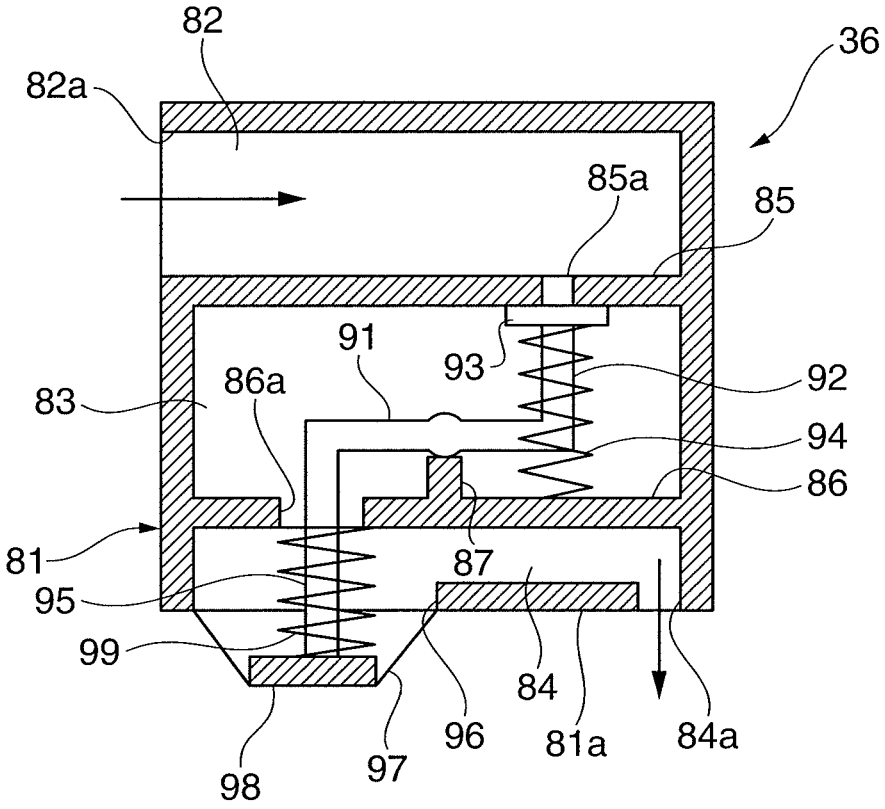
FIG. 6 is a section view showing the structure of the self-sealing unit of the inkjet printer.
Figure 7:
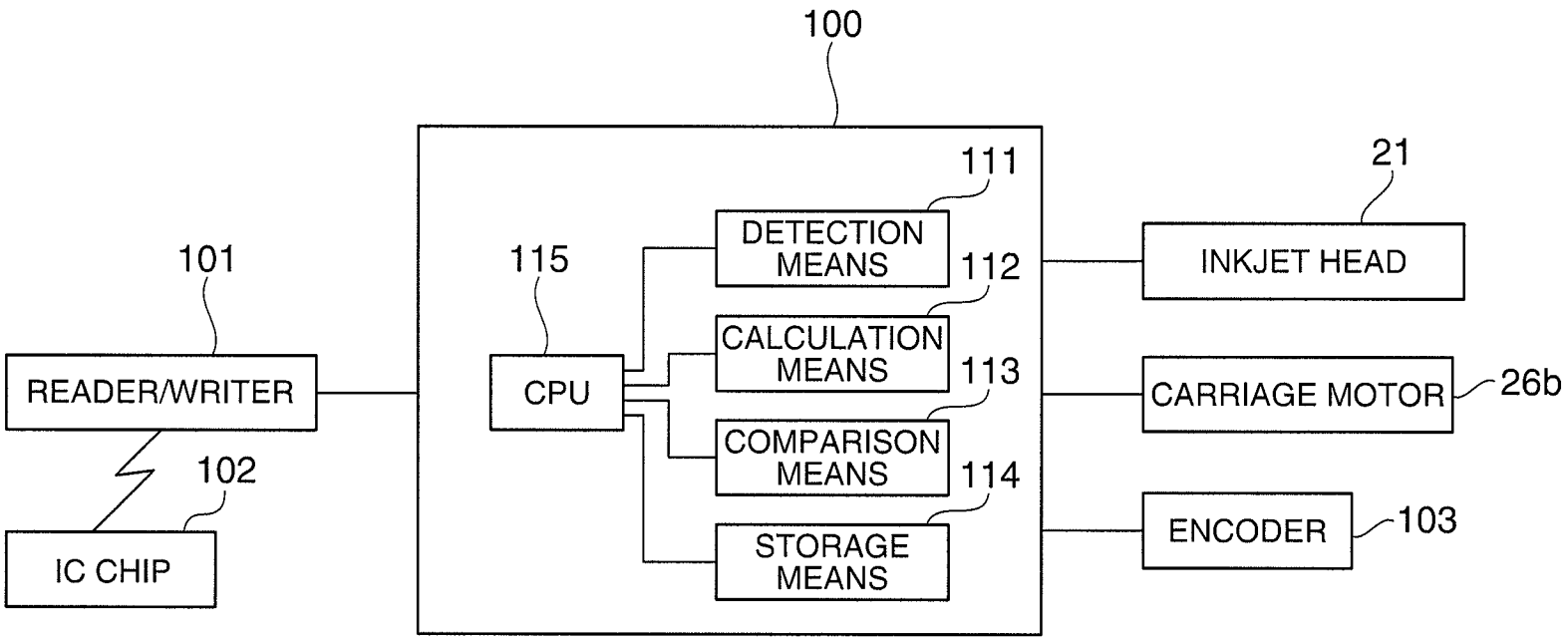
FIG. 7 is a block diagram describing the control system of the inkjet printer.
Figure 8:
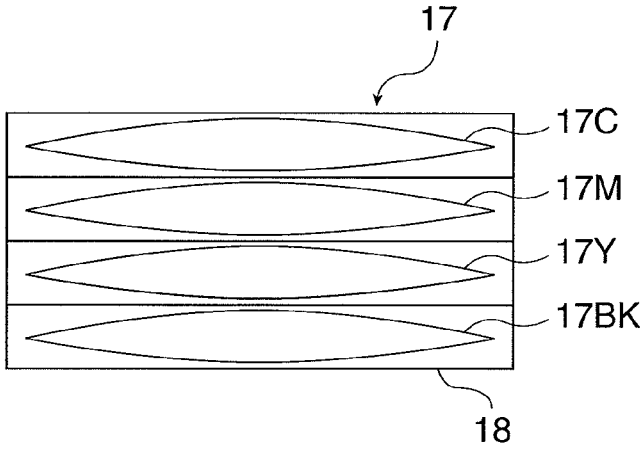
FIG. 8 is a schematic section view showing the structure of the ink cartridge.
Figure 9:
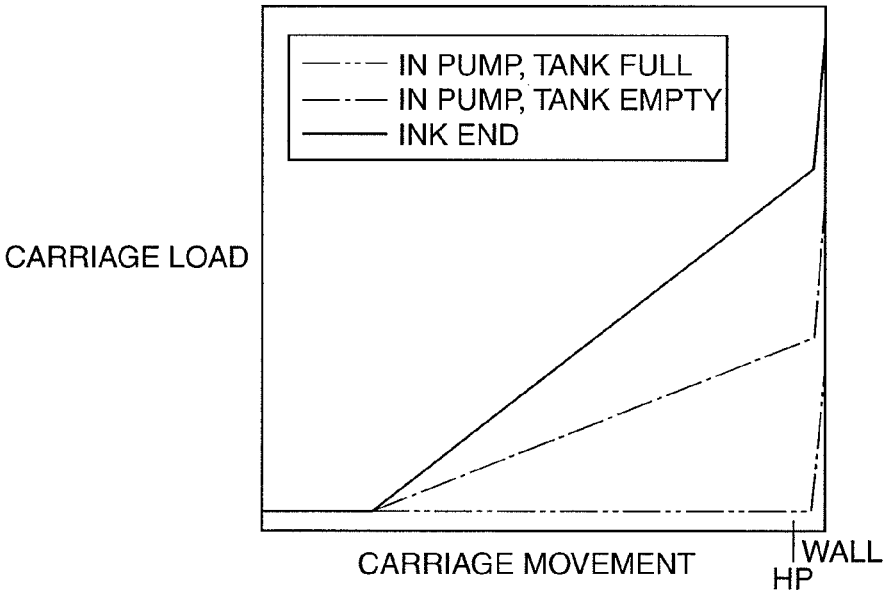
FIG. 9 is a graph showing the relationship between carriage movement and the carriage load.
Figure 10:
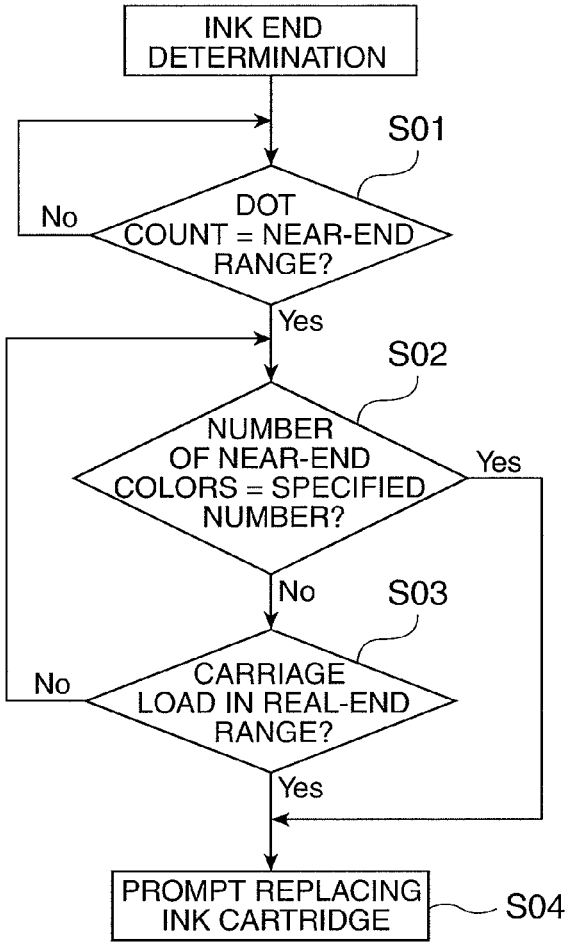
FIG. 10 is a flow chart describing ink cartridge replacement time determination control by the control unit.
Figure 11:
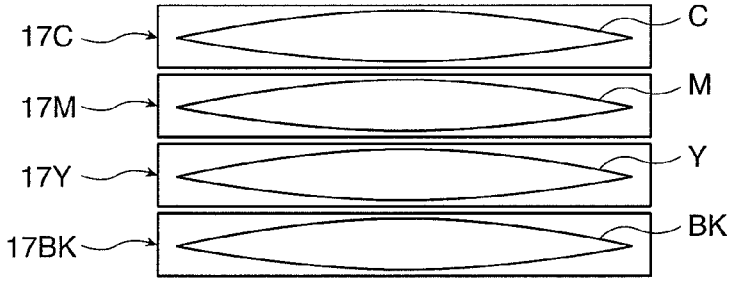
FIG. 11 is a schematic section view showing another ink cartridge structure.

FIG. 1 to FIG. 10 describe an inkjet printer having an ink supply mechanism rendered by a fluid supply device according to a first embodiment of the invention. FIG. 1 is an oblique view of the inkjet printer. FIG. 2 is an oblique view of the inkjet printer with the printer cover open. FIG. 3 is an oblique view of the inkjet printer with the printer case removed. FIG. 4 is a plan view showing the ink pump unit and regulator plate. FIG. 5 is a section view showing the main parts of the ink supply mechanism of the inkjet printer. FIG. 6 is a section view showing the structure of the self-sealing unit. FIG. 7 is a block diagram describing the control system of the inkjet printer. FIG. 8 is a schematic section view showing the structure of the ink cartridge. FIG. 9 is a graph showing the relationship between carriage movement and the carriage load. FIG. 10 is a flow chart describing ink cartridge replacement time determination control by the control unit. FIG. 11 is a schematic section view showing another ink cartridge structure.

The construction of an inkjet printer described as a printing device according to the invention is described below.

As shown in FIG. 1, the inkjet printer 1 uses a plurality of different colors of ink to print in color on a part of the paper delivered from a roll of paper, and has a roll paper cover 5 and an ink cartridge cover 7 disposed to open and close freely at the front of the printer case 2 that covers the printer assembly. A power switch 3, paper feed switch, and indicators are also disposed to the front of the printer case 2.

As shown in FIG. 2, opening the roll paper cover 5 opens the paper compartment 13 in which the roll paper 11 used as the print medium is stored so that the roll paper 11 can be replaced.

Opening the ink cartridge cover 7 opens the cartridge loading unit 15, enabling installing and removing the ink cartridge 17 (main tank) in the cartridge loading unit 15.

In this embodiment of the invention opening the ink cartridge cover 7 also causes the ink cartridge 17 to be pulled a specific distance forward in front of the cartridge loading unit 15.

As shown in FIG. 3, a carriage 23 on which the inkjet head 21 (head) is mounted is disposed above the paper compartment 13 inside the printer case 2. The carriage 23 is supported to move freely widthwise to the roll paper by means of a guide member 25 that extends widthwise to the roll paper 11, and can be moved bidirectionally widthwise to the roll paper 11 above the platen 28 by means of an endless belt **26*a* disposed widthwise to the roll paper 11 and a carriage motor 26*b* that drives the endless belt 26*a*. The inkjet head 21 prints by discharging ink to the part of the roll paper 11** delivered thereto.

As shown in the figure, the standby position (home position) of the bidirectionally moving carriage 23 is above the cartridge loading unit 15. A cap 27 that covers the ink nozzles of the inkjet head 21 exposed below the carriage 23, and an ink vacuum mechanism 29 for vacuuming and disposing of ink inside the ink nozzles of the inkjet head 21 through the cap 27, are disposed below this standby position.

The ink cartridge 17 stores a plurality of color ink packs (storage units) 17C, 17M, 17Y, 17BK inside the cartridge case 18. Each of the ink packs (storage units) 17C, 17M, 17Y, 17BK is made of a flexible material and is sealed with ink stored inside. When the ink cartridge 17 is loaded into the cartridge loading unit 15, an ink supply needle not shown disposed on the cartridge loading unit 15 side is inserted to and connects with the ink supply opening of the ink pack. The ink path 31 fixed inside the printer case 2 is connected to the ink supply needle of the cartridge loading unit 15, and one end of a flexible ink supply tube 33 having a channel for each color is connected to the ink path 31.

The other end of the ink supply tube 33 is connected to an ink pump unit 34 disposed to the carriage 23 for each color. Each ink pump unit 34 is disposed above the inkjet head 21, and connected to the self-sealing unit 36 connected to the inkjet head 21.

In addition to the inkjet head 21, the ink pump unit 34 and the self-sealing unit 36 are disposed in unison with the carriage 23.

As a result, ink from each of the ink packs (storage units) 17C, 17M, 17Y, 17BK inside the ink cartridge 17 is supplied to the ink nozzles of the inkjet head 21 from the ink supply needle of the cartridge loading unit 15 through the ink path 31, the ink supply tube 33, the ink pump unit 34 for each color, and the self-sealing unit 36 for each color.

The ink pump unit 34 pulls ink from the ink cartridge 17 by moving the carriage 23 relative to the frame of the printer 1, and a regulator panel 37 that causes the ink pump unit 34 to operate by moving the carriage 23 is disposed to the front in the direction of carriage 23 movement to the standby position.

The ink supply mechanism (fluid supply mechanism) in this inkjet printer 1 is rendered by the ink cartridge 17, the sub tank 45, the inkjet head 21, the carriage 23, and the ink pump unit 34.

The ink pump unit 34 of the ink supply mechanism is described below using by way of example the structure related to one color.

As shown in FIG. 5, a back-flow prevention valve 41 is disposed to one end part 32 of the ink path 31 on the ink cartridge 17 side, and the back-flow prevention valve 41 prevents ink from flowing between the ink cartridge 17 and the ink pump unit 34 from the ink cartridge 17 side to the ink pump unit 34 side.

The ink pump unit 34 includes a sub tank 45 for drawing ink from the ink cartridge 17 through the ink supply tube 33. This sub tank 45 has a top part 46 and a bottom part 47, and an ink chamber 50 (fluid chamber) is formed between the top part 46 and bottom part 47 with the top of the ink chamber 50 covered by a flexible membrane 49 that is a flexible diaphragm. The flexible membrane 49 is made of butyl rubber, for example, with low moisture permeability and gas permeability.

The ink chamber 50 communicates with the ink supply tube 33 and with the path 42 on the self-sealing unit 36 side so that ink can be supplied from the ink cartridge 17 and ink can be supplied to the self-sealing unit 36 side. A back-flow prevention valve 43 is disposed to the end of the path 42 on the self-sealing unit 36 side, and the back-flow prevention valve 43 enables ink to flow between the ink chamber 50 and self-sealing unit 36 from the ink chamber 50 side to the self-sealing unit 36 side.

The flexible membrane 49 is made from an easily deformable flexible material, and the volume of the ink chamber 50 can change, expanding and contracting, as the flexible membrane 49 deforms. An expansion mechanism 52 that causes the flexible membrane 49 to displace to expand the ink chamber 50 is disposed to the ink pump unit 34.

The expansion mechanism 52 includes a tubular cylinder 53 that rises vertically, a piston 54 (moving member) that is inserted so that it can slide vertically inside the cylinder 53, a rocker arm 56 (engaging member) that is supported to rock on a rocker pin 55 above the cylinder 53 in the top part 46, and a coil tension spring 57 (elastic unit) that is interposed between the rocker arm 56 and piston 54.

The cylinder 53 is made from a plastic material such as polypropylene with low moisture permeability and gas permeability. The cylinder 53 has a necked configuration with a small diameter inside surface 59 formed at the top with an inside diameter that is slightly greater than the outside diameter of the piston 54 to slidably guide the outside surface of the piston 54, and a large diameter inside surface 60 formed at the bottom with a space between it and the outside surface of the piston 54.

The piston 54 is made from a plastic material such as polypropylene with low moisture permeability and gas permeability. The piston 54 is substantially cylindrical with a bottom, and has a slot from the top end to the middle on the rocker arm 56 side for positioning the rocker arm 56.

A catch 67 that holds the bottom end of the coil tension spring 57 is formed at a position above the bottom of the piston 54.

The rocker arm 56 has an arm part 69 that extends inside the cylinder 53 from the rocker pin 55, a vertical leg 70 that extends down from the rocker pin 55, and an input part 71 that extends in the opposite direction as the arm part 69 from the opposite end of the vertical leg 70 as the arm part 69. The distal end of the arm part 69 is hook shaped, and holds the top end of the coil tension spring 57.

The flexible membrane 49 is an integral molding having an annular thick-wall base part 74 that is disposed between the top part 46 and bottom part 47 fit into an annular groove 73 in the top part 46, a thin-wall membrane part 75 that extends with a cylindrical shape from the inside diameter part of the base part 74, and a thick-walled, substantially disc-shaped fixed part 76 that occludes the opposite side of the membrane part 75 as the base part 74.

A nipple 77 that tapers substantially to a point at the distal end is formed in unison to the middle of the fixed part 76, and this nipple 77 is press-fit into and held by a slit 65 formed in the piston 54. When thus disposed, the fixed part 76 is held in unison with the bottom of the piston 54, and the fixed part 76 and membrane part 75 of the flexible membrane 49 are displaced as the piston 54 moves.

As shown in FIG. 6, the self-sealing unit 36 has a supply path 82, a middle path 83, and a discharge path 84 formed in a unit housing 81. The downstream end part of the path 42 is connected to the supply opening 82*a* rendered to the supply path 82, and the inkjet head 21 is connected to the discharge opening 84*a* rendered to the discharge path 84.

A flow opening 85*a* is formed in the divider wall 85 separating the supply path 82 and middle path 83, and ink in the supply path 82 flows through the flow opening 85*a* into the middle path 83. A communication hole 86*a* is formed in the divider wall 86 separating the middle path 83 and discharge path 84, and ink in the middle path 83 flows through this communication hole 86*a* into the discharge path 84.

A support unit 87 is formed on the divider wall 86 inside the middle path 83, and a rocker arm 91 is pivotably supported on this support unit 87. An operating rod 92 that bends toward the divider wall 85 side is formed in unison to one end of the rocker arm 91, and an occlusion plate 93 that contacts the divider wall 85 and closes the flow opening 85*a* is rendered on the distal end of this operating rod 92. A compression spring 94 is disposed between the occlusion plate 93 and divider wall 86, and the occlusion plate 93 is urged toward the divider wall 85 side by the urging force of this compression spring 94. A pusher rod 95 that is inserted through the communication hole 86*a* in the divider wall 86 is formed bending toward the divider wall 86 side at the other end of the rocker arm 91.

An opening 96 is formed in the side wall 81*a* of the unit housing 81 on the discharge path 84 side. A film 97 that is liquid-tight and flexible is attached with a liquid-tight connection to the lip part of the opening 96. A pressure plate 98 is fixed to the middle part of the film 97 on the discharge path 84 side. The distal end of the pusher rod 95 part of the rocker arm 91 contacts this pressure plate 98.

A compression spring 99 is attached between the pressure plate 98 and the divider wall 86, and the pressure plate 98 is pushed to the outside by the urging force of this compression spring 99. The occlusion plate 93 in this self-sealing unit 36 is thus pressed to the divider wall 85 by the compression spring 94 and the pressure working on the occlusion plate 93, and thus closes the flow opening 85*a*.

When the capacity of the part covered by the film 97 in this self-sealing unit 36 decreases and the pusher rod 95 part of the rocker arm 91 is pushed by the pressure plate 98, the rocker arm 91 rocks at the point where it is supported on the support unit 87, and the occlusion plate 93 separates from the divider wall 85. Ink thus flows from the supply path 82 through the flow opening 85*a* into the middle path 83 and discharge path 84, and is supplied to the inkjet head 21.

By disposing this self-sealing unit 36 on the upstream side of the inkjet head 21, variation in the ink pressure on the supply side caused by acceleration or deceleration of the carriage 23, for example, is prevented by the self-sealing unit 36 from being transmitted to the inkjet head 21.

As a result, problems caused by transmission of such pressure variation, including unintended discharge of ink from the inkjet head 21, ink smears, and missing dots caused by defective discharge, for example, are prevented.

When the carriage 23 is in the standby position in the inkjet printer 1 configured as described above, the input part 71 of the rocker arm 56 contacts the regulator panel 37 of the carriage 23, the vertical leg 70 is vertical, and the arm part 69 and input part 71 are horizontal. The piston 54 is pulled up by the urging force of the coil tension spring 57 at this time.

When the carriage 23 leaves the standby position and is moved to the printing area of the inkjet head 21, and ink is then discharged from the inkjet head 21 in the printing area to print, ink is supplied from the self-sealing unit 36 to the inkjet head 21, the inside of the self-sealing unit 36 goes to negative pressure, and ink is supplied from the ink chamber 50 through the path 42 to the self-sealing unit 36.

When the amount of ink in the ink chamber 50 drops, the decrease in ink produces a negative pressure, and the piston 54 and fixed part 76 descend in unison while deforming the membrane part 75 of the flexible membrane 49. As a result, the rocker arm 56 connected through the coil tension spring 57 to the piston 54 rocks and causes the distal end of the arm part 69 to descend, thus causing the amount that the rocker arm 56 protrudes to the input part 71 side to increase.

When the carriage 23 returns to the standby position, the rocker arm 56 that moves with the carriage 23 contacts the regulator panel 37 outside the carriage 23 at the input part 71, the rocker arm 56 therefore rocks as a result of carriage 23 movement, and the input part 71 returns to vertical and the arm part 69 and input part 71 return to horizontal. As a result, the distal end part of the arm part 69 rises, and the piston 54 connected thereto through the coil tension spring 57 slides inside the cylinder 53 and is pulled up.

Movement of the piston 54 through the coil tension spring 57 causes the fixed part 76 of the flexible membrane 49 of the ink pump unit 34 to rise in unison with the piston 54, expanding the ink chamber 50 of the sub tank 45 and increasing the capacity. When the capacity of the ink chamber 50 increases, ink is drawn into the ink chamber 50 through the ink path 31 and ink supply tube 33 from the ink cartridge 17 while the back-flow prevention valve 41 opens and the back-flow prevention valve 43 closes.

The control unit 100 of the inkjet printer 1 configured as described above executes the above ink supply operation at a specific timing during the printing operation. Note that this ink supply operation is executed as long as there is at least enough ink left in the ink chamber 50 to enable supplying ink to the inkjet head 21 even if printing consumes the maximum amount of ink.

As shown in FIG. 7, the control unit 100 of the inkjet printer 1 controls driving the inkjet head 21 and carriage motor 26*b* by sending control signals to the inkjet head 21 and carriage motor 26*b* to execute the roll paper 11 printing process. An encoder 103 that sends carriage 23 position information is also connected to the control unit 100. The control unit 100 detects the position of the carriage 23 based on the signal from the encoder 103.

The control unit 100 has a detection means 111, a calculation means 112, a comparison means 113, a storage means 114, and a CPU 115, and the detection means 111, calculation means 112, and comparison means 113 are controlled by means of the CPU 115.

The detection means 111 detects the carriage motor 26*b* current. Based on the current detected by the detection means 111, the calculation means 112 calculates and integrates the carriage load, which is the load required to move the carriage 23, as a current value. The comparison means 113 compares a threshold value previously stored in the storage means 114 with the integral of the carriage load derived from the current by the calculation means 112. Based on the result of the comparison from the comparison means 113, the CPU 115 determines the remaining ink level in the ink cartridge 17.

As shown in FIG. 8, the four color (C, M, Y, BK) ink packs (storage units) 17C, 17M, 17Y, 17BK, which are made of a flexible material and have a variable capacity, are sealed in the ink cartridge 17 with the respective color of ink stored inside each ink pack.

Therefore, when the remaining ink level inside decreases and the ink pack goes to a near-empty state, the load required to expand the ink chamber 50 and draw in ink increases. More specifically, because the load of moving the carriage 23 in order to expand the ink chamber 50 increases and the carriage motor 26*b* current increases greatly when the ink packs 17C, 17M, 17Y, 17BK in the ink cartridge 17 are empty of ink, the threshold value stored in the storage means 114 is set based on the current required when there is no ink. The control unit 100 configured as described above detects when there is no ink left and the ink packs 17C, 17M, 17Y, 17BK are empty.

It should be noted that "empty" as used herein means a state in which supplying the desired amount of ink from the ink packs 17C, 17M, 17Y, 17BK is difficult, and includes situations in which some ink remains in the ink packs 17C, 17M, 17Y, 17BK.

As shown in FIG. 9, when the ink chamber 50 is full of ink, the carriage load is constant to the home position (HP), that is, the standby position (denoted by the double-dot dash line in FIG. 9).

When ink is consumed and the ink volume in the ink chamber 50 decreases, the carriage load increases from when the input part 71 of the rocker arm 56 contacts the regulator panel 37 due to ink in the ink packs 17C, 17M, 17Y, 17BK being drawn into the ink chamber 50 and the ink volume in the ink chamber 50 increasing as denoted by the dot-dash line in FIG. 9.

If the ink packs 17C, 17M, 17Y, 17BK are depleted of ink, ink will not be drawn into the ink chamber 50. The coil tension spring 57 therefore expands from when the input part 71 of the rocker arm 56 contacts the regulator panel 37 in this condition, and the carriage load increases greatly according to the force of the spring (denoted by the solid line in FIG. 9).

More specifically, the carriage load differs greatly when the ink packs 17C, 17M, 17Y, 17BK are depleted of ink and when ink remains thereinside. It is therefore possible to quickly and easily determine if the ink cartridge 17 is empty (ink end) by comparing the integral of the carriage load required to move the carriage 23 with the threshold value.

If the carriage 23 moves passed the home position (HP), reaches the end, and further movement is stopped, the carriage load rises suddenly as shown in FIG. 9 in each of these patterns. The origin of the carriage 23 can be set by detecting the point of this sudden increase in the carriage load.

A reader/writer 101 is also connected to the control unit 100. The reader/writer 101 reads and writes ink information to an IC chip 102 disposed in the ink cartridge 17. The ink information written to the IC chip 102 includes, for example, ink consumption, the remaining ink level, the waste ink amount, the date of first use, and device information denoting the device using the ink cartridge 17, for example.

The control unit 100 reads the ink information stored in the IC chip 102 of the ink cartridge 17 loaded in the cartridge loading unit 15 by means of the reader/writer 101. If the loaded ink cartridge 17 is new, the date of first use and the device information is written to the IC chip 102.

When a printing process or cleaning process is executed, the calculation means 112 determines the dot count denoting the number of ink droplets discharged from the inkjet head 21 in the printing process or cleaning process, updates the total ink consumption value by adding the calculated dot count to the ink consumption value already stored as a dot count in the IC chip 102, and writes the updated dot count to the IC chip 102.

The replacement time determination control process whereby the control unit 100 determines the ink cartridge 17 replacement time is described next with reference to the flow chart in FIG. 10.

The control unit 100 first determines whether or not the dot count, which represents ink consumption from each of the ink packs 17C, 17M, 17Y, 17BK, has reached the near-end range and the remaining ink level has reached a specified remaining ink level (step S01).

The near-end range is the range from when the ink in the ink packs 17C, 17M, 17Y, 17BK decreases to a certain low level until the ink pack is empty. When the dot count of the remaining ink level reaches this near-end range, the amount of ink left in the ink packs 17C, 17M, 17Y, 17BK is a predetermined minimal level.

If it is decided that the dot count has reached the near-end range and the remaining ink level is the predetermined level (step S01 returns Yes), whether or not the number of ink colors in the near-end range is greater than or equal to a specified number set as a threshold value is determined (step S02).

This specified number in this embodiment of the invention is four, and whether or not the remaining ink level has reached the near-end range in all of the ink packs 17C, 17M, 17Y, 17BK of the ink cartridge 17 is determined.

If it is determined that the number of colors in the near-end range is less than the specified number of 4 (step S02 returns No), whether or not the carriage 23 load is in the real-end range is determined (step S03).

More specifically, whether the integral of the carriage load reaches the real-end range set as the threshold value when the carriage 23 moves to the standby position for the ink refill operation, and at least one of the ink packs 17C, 17M, 17Y, 17BK is empty of ink (the real end), is determined.

If it is determined that, for example, the cyan ink stored in ink pack 17C has reached the real-end range, (step S03 returns Yes), replacing the ink cartridge 17 is prompted by an appropriate display (step S04).

If it is determined that no color of ink has reached the real-end range, (step S03 returns No), control returns to step S02 and the number of colors of ink in the near-end range is determined.

If step S02 determines that the number of colors in the near-end range is the specified number of 4 (step S02 returns Yes), replacing the ink cartridge 17 is prompted by an appropriate display (step S04).

In a configuration that draws ink from the ink cartridge 17 as a result of an expansion mechanism 52 expanding the ink chamber 50 using the force of carriage 23 movement, this embodiment of the invention prompts replacing the ink cartridge 17 when the ink in a maximum of three of the four ink packs 17C, 17M, 17Y, 17BK is determined to be in the real-end range, and can therefore avoid the ink in all four ink packs 17C, 17M, 17Y, 17BK reaching the real end at the same time.

More specifically, because it is possible to determine that the ink cartridge 17 replacement time has come before the specified number of ink colors reaches the real end and the load of moving the carriage 23 becomes high, the maximum load of carriage 23 movement can be reduced, and a smaller carriage motor 26*b* and carriage 23 drive mechanism can be used.

As a result, the ink cartridge 17 can be replaced at the appropriate time without increasing device size or cost.

Furthermore, because it can be determined that it is time to replace the ink cartridge 17 when at least one of the ink packs 17C, 17M, 17Y, 17BK in the ink cartridge 17 is determined to have reached the ink end based on the load required to move the carriage 23, ink waste can be reduced and the ink cartridge 17 can be replaced at the appropriate time.

It should be noted that the foregoing embodiment uses a color printer 1 that discharges four colors of ink from the inkjet head 21 by way of example to describe prompting replacing the ink cartridge 17 when all four colors of ink are in the near-end range, but the specified number of ink colors in the near-end range that is used to decide whether or not to prompt replacing the ink cartridge 17 is not limited to four.

The foregoing embodiment is described using a single ink cartridge 17 containing ink packs 17C, 17M, 17Y, 17BK for four colors, but the invention can also be applied when using separate, individually replaceable ink cartridges 17C, 17M, 17Y, 17BK each containing a single color of ink, that is, cyan ink C, magenta ink M, yellow ink Y, and black ink BK, respectively.

In this configuration, when the number of ink colors in the near-end range is not the specified number (step S02 returns No), but the ink in any one of the ink cartridges 17C, 17M, 17Y, 17BK is determined to be in the real-end range (step S03 returns Yes), replacing only the ink cartridge containing the color of ink determined to be in the real-end range is prompted (step S04).

In other words, when separate ink cartridges 17C, 17M, 17Y, 17BK are used, it is possible to replace only the ink cartridge that is empty of ink, and it is not necessary to replace ink cartridges that still contain ink.

In addition to inkjet printers as described above, the fluid supply device according to the invention can be applied in fluid supply devices that supply fluid to fluid discharge heads for discharging a variety of fluids, including color agent discharge heads used in manufacturing color filters for liquid crystal displays, electrode material discharge heads used for forming electrodes in organic EL display and FED (field emission display) devices, and bio-organic material discharge heads used in biochip manufacture. The invention can also be used in a fluid supply device for a reagent discharge device used as a precision pipette.

The concept of a fluid as used herein also includes gels, high viscosity materials, and mixtures of a solid in a solvent, and the concept of an ink includes aqueous inks and oil-based inks.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fluid supply device comprising:

a main tank that stores fluid in a plurality of storage units;

a sub-tank having a fluid chamber to which fluid is supplied from the main tank;

a head that discharges fluid supplied from the sub-tank;

a movable carriage on which the head and the sub-tank are mounted;

an expansion mechanism that expands the fluid chamber to draw fluid from the main tank by movement of a moving member as a result of carriage movement, the expansion mechanism including an elastic member having a first connection point and a second connection point, the elastic member being elastically deformable between the first and second connection points, the first connection point being configured to move in response to a movement of the carriage and the second connection point being drivingly coupled with the moving member;

a calculating unit that calculates a remaining fluid volume in the storage units of the main tank from a fluid discharge volume from the head; and a decision unit configured to determine that the main tank replacement time has arrived when the remaining fluid volume in a specified plural number of storage units is at or below a specified remaining fluid volume based on the calculated result from the calculating unit, the specified plural number being greater than one storage unit of the plurality and less than all the storage units of the plurality.

2. The fluid supply device described in claim 1, wherein:

the decision unit determines the main tank replacement time has arrived when a load required to move the carriage is determined to be within a real-end range.

3. The fluid supply device described in claim 2, wherein:

the storage units can be individually replaced.

4. A printing device that executes a printing process of discharging ink from a head to a conveyed medium, comprising:

the fluid supply device described in any of claims 1 to 3 as a device that supplies ink to the head.

5. The printing device described in claim 1, wherein the decision unit is configured such that the main tank replacement time is determines when each of the specified plural number of storage units is at or below a specified remaining fluid volume based on the calculated result from the calculating unit.

6. The printing device described in claim 2, wherein the decision unit is configured to determine that the replacement time has arrived based on the remaining fluid volume in the specified plural number of storage units based on the calculation of the fluid discharge volume from the calculating unit whether or not a determination that the carriage load is in the real-end range.

7. The fluid supply device described in claim 6, wherein:

the decision unit is further configured to determine that the main tank replacement time has arrived when based on a determination that the carriage load is within the real-end range after a determination that the remaining fluid volume in the specified plural number is neither at nor below the specified remaining fluid volume such that the main tank replacement time is determined before the specified plural number of storage units are empty without exceeding a maximum load on the carriage.

8. A control method comprising:

providing a fluid supply device that has a main tank that stores fluid in a plurality of storage units, a sub-tank having a fluid chamber to which fluid is supplied from the main tank, a head that discharges fluid supplied from the sub-tank, a movable carriage on which the head and the sub-tank are mounted, and an expansion mechanism that expands the fluid chamber to draw fluid from the main tank by movement of a moving member as a result of carriage movement, the expansion mechanism including an elastic member having a first connection point and a second connection point, the elastic member being elastically deformable between the first and second connection points, the first connection point being configured to move in response to a movement of the carriage and the second connection point being drivingly coupled with the moving member, the control method comprising:

calculating a remaining fluid volume in the storage units of the main tank from a volume of fluid discharged from the head; and determining that a main tank replacement time has arrived when the remaining fluid volume in a specified plural number of storage units is at or below a specified remaining fluid volume, the specified plural number being greater than one storage unit of the plurality and less than all the storage units of the plurality.

9. The control method for a fluid supply device described in claim 8, further comprising:

determining that the main tank replacement time has arrived when a load required to move the carriage is determined to be within a real-end range.

10. The method described in claim 8, wherein the main tank replacement time is determined when each of the specified plural number of storage units is at or below a specified remaining fluid volume based on a calculated fluid discharge volume.

11. The method described in claim 9, further comprising:

determining that the replacement time has arrived based on the remaining fluid volume in the specified plural number of storage units based on the calculated fluid discharge volume whether or not the carriage load is determined to be within the real-end range.

12. The method described in claim 11, wherein the main tank replacement time is determined based on a determination that the carriage load is within the real-end range after a determination that the remaining fluid volume in the specified plural number is neither at nor below the specified remaining fluid volume such that the main tank replacement time is determined before the specified plural number of storage units are empty without exceeding a maximum load on the carriage.

13. A printing device comprising:

an ink cartridge having a plurality of storage units that store ink;

a sub tank to which ink stored in the ink cartridge is supplied by a pump unit;

an inkjet head that discharges the ink supplied to the sub tank;

a carriage on which the inkjet head is mounted and which moves bi-directionally;

a drive unit that drives the carriage bi-directionally; and a decision unit that determines a replacement time for the ink cartridge;

the pump unit having an expansion mechanism that expands an ink chamber formed in the sub tank, the expansion unit including a cylindrical cylinder, a movable member that moves inside the cylinder, and a rocking arm member that rocks in conjunction with a decrease in the ink volume in the ink chamber, and operates the movable member, expands the ink chamber, and fills the ink chamber with ink in response to a movement of the carriage, and wherein the decision unit is configured to:

determine whether or not a remaining ink volume in a specified plural number of storage units of the ink cartridge is at or below a specified remaining volume in a near-end range based on a calculated volume of ink discharged from the inkjet head, the specified plural number being greater than one storage unit of the plurality and less than all the storage units of the plurality, determine if the plural number of storage units in the near-end range is greater than or equal to a specified number if the remaining ink volume is determined to be at or below the specified remaining volume, determine that a real-end range has been reached if the ink cartridge and the ink chamber are empty of ink and a carriage movement load is high if the number of storage units in the near-end range is less than the specified number, and determine that the replacement time for the ink cartridge has arrived and prompting ink cartridge replacement if the real-end range has been reached.

14. The printing device described in claim 13, wherein:

the drive unit is a motor; and the drive current of the motor is detected and used to determine the carriage movement load.

15. The printing device described in claim 13, wherein:

each storage unit is an individually replaceable unit provided separately for each color of ink employed.

16. The printing device described in claim 13, wherein:

the ink cartridge is an integrated cartridge having a plurality of storage units provided separately for each color of ink employed.

* * * * *